United States Patent [19]

Yamasaki

[11] Patent Number: 4,782,823

[45] Date of Patent: Nov. 8, 1988

[54] ROLL ROTATION TYPE MASSAGING APPARATUS

[75] Inventor: Yoshikiyo Yamasaki, Osaka, Japan

[73] Assignee: Kabushiki Kaisha Fuji Iryoki, Osaka, Japan

[21] Appl. No.: 26,938

[22] Filed: Mar. 17, 1987

[51] Int. Cl.[4] ..... A61H 15/00

[52] U.S. Cl. ..... 128/57; 128/55

[58] Field of Search ..... 128/57, 60, 61, 54, 128/55, 58

[56] References Cited

U.S. PATENT DOCUMENTS

| | | | |
|---|---|---|---|
| 1,630,911 | 5/1927 | Wentz | 128/57 |
| 1,710,051 | 4/1929 | Giacopazzi | 128/57 |
| 2,909,174 | 10/1959 | Heldenbrand | 120/57 |
| 2,939,455 | 6/1960 | Arnold | 128/57 |
| 2,976,867 | 3/1961 | Schaeffer | 128/57 |
| 3,205,888 | 9/1965 | Stroop | 128/57 |
| 3,468,305 | 9/1969 | Collomp et al. | 128/57 |

FOREIGN PATENT DOCUMENTS

| | | | |
|---|---|---|---|
| 1282851 | 11/1968 | Fed. Rep. of Germany | 128/57 |
| 1491562 | 2/1970 | Fed. Rep. of Germany | 128/57 |
| 1930989 | 12/1970 | Fed. Rep. of Germany | 128/57 |
| 2947277 | 5/1981 | Fed. Rep. of Germany | 128/57 |
| 2305167 | 11/1976 | France | 128/57 |
| 2477870 | 9/1981 | France | 128/57 |
| 703632 | 4/1966 | Italy | 128/57 |
| 842546 | 7/1960 | United Kingdom | 128/57 |

*Primary Examiner*—David Wiecking
*Assistant Examiner*—Tonya Lamb
*Attorney, Agent, or Firm*—Flynn, Thiel, Boutell & Tanis

[57] ABSTRACT

A roll rotation type massaging apparatus comprises a roll rotating unit including a driving unit installed within a rotating cylinder having a cylindrical body and having supporting caps to support a driving shaft installed at both sides of the opening faces of the cylindrical body, a drum cylinder fixed on the outer face of the rotating cylinder, and a rotating roll having cylindrical bars with ellipsoidal massaging members and cylindrical supporting members loosely installed thereon which are installed at equal distances between the sides of the body of the drum cylinder along the circumference thereof and a reinforcement frame with a reinforcement bar connected between boards which supports the roll rotating unit. This compact apparatus rotates the rotating roll having ellipsoidal massaging members without using a motor belt. The ellipsoidal massaging materials of the apparatus contact the effective part of the user to massage the whole effective part evenly. The drum cylinder includes small size cylinders to strengthen the cylindrical bars. The apparatus has few troubles such as breakdown because of an accident, and it roll massages all parts of the human body by a proper force, having the same effect as an acupuncture treatment.

6 Claims, 4 Drawing Sheets

ROLL ROTATION TYPE MASSAGING APPARATUS

BACKGROUND OF THE INVENTION

1. Field of the Invention

This invention relates to a roll rotation type massaging apparatus to roll-massage all parts of the body with a rotating roll which can be easily carried and installed any place because of its compact body and has the same effect as conventional finger-pressure massaging apparatus.

2. Description of Prior Art

It is well known to provide a drum rotation type massaging apparatus comprising a series of ellipsoids installed on the whole outer surface of drums driven by a driving motor through a belt to massage the affected part of the user by contacting said affected part with said ellipsoids being rotated by the rotation of said driving motor.

However, such a drum rotation type massaging apparatus of the structure described above requires a large area to house the driving motor, the drums, and the belt and frequently has troubles such as the drum failing to rotate.

Furthermore, in operation, only each top part of said ellipsoids is applied to the affected part of the user, therefore, only a small part of the affected part, for example some points of the back at equal distances, can be contacted laterally. Therefore, such an apparatus cannot wholly massage the affected part of the user unless he moves either his body or the apparatus.

SUMMARY OF THE INVENTION

While the invention is believed to be readily understood from the above description, a brief summary will now be set forth.

The roll rotation type massaging apparatus according to this invention comprises (1) a roll rotating unit including a driving unit installed within, a rotating cylinder having a cylindrical body and having supporting caps to support a driving shaft installed at both sides of the opening faces of said cylindrical body, a drum cylinder fixed on the outer face of said rotating cylinder, and a rotating roll having cylindrical bars with ellipsoidal massaging members and cylindrical supporting members loosely installed thereon at equal distances between the sides of the body of said drum cylinder along the circumference thereof, characterized in that a reinforcement frame with a reinforcement bar connected between two boards supports said roll rotating unit to provide a compact body apparatus, (2) the cylindrical bars, installed between the sides of said drum cylinder, consist of first cylindrical bars on which ellipsoidal massaging members and cylindrical supporting members are alternately loosely installed and second cylindrical bars on which said ellipsoidal massaging members and said cylindrical supporting members are loosely installed in the reverse order of said first cylindrical bars, and are installed at equal distances around the circumference of said drum cylinder and are characterized in that said massaging members contact the whole affected part of a user of this apparatus as frequently as possible.

OBJECT OF THE INVENTION

It is an object of the invention to provide a compact apparatus which rotates a rotation roll with ellipsoidal massaging members without using a motor belt.

It is another object of the invention to provide an inexpensive, durable and compact roll rotation type massaging apparatus with ellipsoidal massaging members which contact a large part of the affected part of a user to evenly massage the whole of said affected part.

Figure 1:
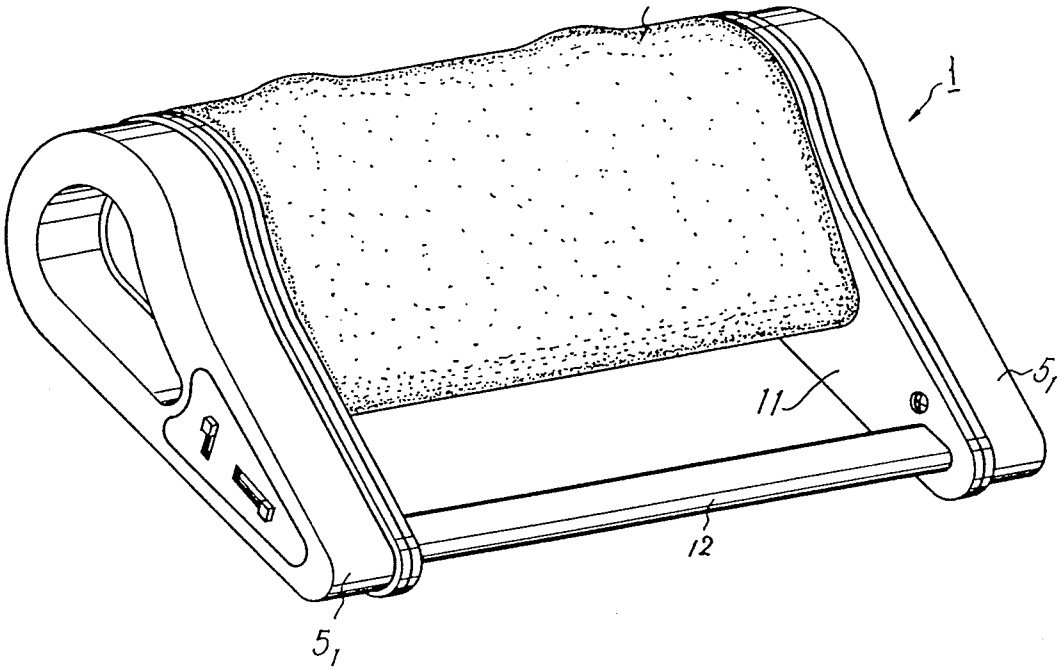
FIG. 1 is a perspective view of an embodiment of the roll rotation type massaging apparatus according to this invention.

DESCRIPTION OF THE PREFERRED EMBODIMENT 1 is a roll rotation massaging apparatus according to this invention. Said massaging apparatus 1 comprises roll rotating unit 2 and U-shaped reinforcement frame 10 for said roll rotating unit 2. Said roll rotating unit 2 comprises rotating cylinder 3 having a cylindrical body 4 with supporting bearing $5_3$ at both ends thereof, a driving unit 6 within the body 4, and rotating roll 7 fixed to the cylinder 3. The roll 7 includes cylindrical bars 9 having ellipsoidal-shaped massaging members $9_4$ rotatably supported thereon, which bars extend between end flanges $8_2$ and $8_2$ of drum cylinder 8, which cylinder has a cylindrical body 8, which is fixed on the outer face of said rotating cylinder 3. The bars 9 are equally angularly spaced around drum 8.

Said cylindrical body 4 is a small diameter cylinder made of a material such as a resin or metal and contains a small size driving unit 6.

A supporting cap 5 comprises a cap body $5_1$ with a slot-like hole $5_2$ through the end wall $5_4$ for supporting the flattened end of shaft $6_2$ of said driving unit 6 to support said driving unit in a sealed state.

Said driving unit 6 comprises a conventional motor and speed reducer which is disposed within the interior of cylindrical body 4 and drivingly engages the inner wall thereof for effecting rotation thereof.

Said rotating roll 7 comprises the drum-shaped drum cylinder 8 made of a material such as a resin or metal and the cylindrical bars 9 installed at equal angles therearound between the sides $8_2$ and $8_2$ of body $8_1$ of said drum cylinder 8 to coaxially rotate with said cylindrical body 4.

Said reinforcement frame 10 comprises a pair of end plates $10_1$ which overlie the end bearings $5_3$ and have slots $10_3$ for accommodating the flattened ends of shaft $6_2$ so that the shaft is nonrotatable relative to frame 10. The end plates $10_1$ are connected by a reinforcement bar $10_2$.

11 is a sideboard fastened to the outer surface of each end plate $10_1$. The sideboard covers 11 have a clamping element 17 extending therebetween and which receives clamping rods 19 and forms a clamping structure for maintaining a covering cloth 15 taut. A bar 13 extends between sideboards 11 and clamps to the element 17 as by screws 14. There is a bar 12 installed between said end walls $5_4$ and $5_4$ to enable said roll rotation type massaging apparatus 1 to be carried and installed at a needed place. Retainer plates 18 receive the respective ends of shaft $6_2$ therethrough and are fixed to the outside face of respective inner walls $5_4$ of the supporting caps 5.

15 is a covering cloth for covering the outer surface of said rotating roll 7 and is provided so that said massaging members can contact the affected part of the users with as little shock as possible.

Figure 5:
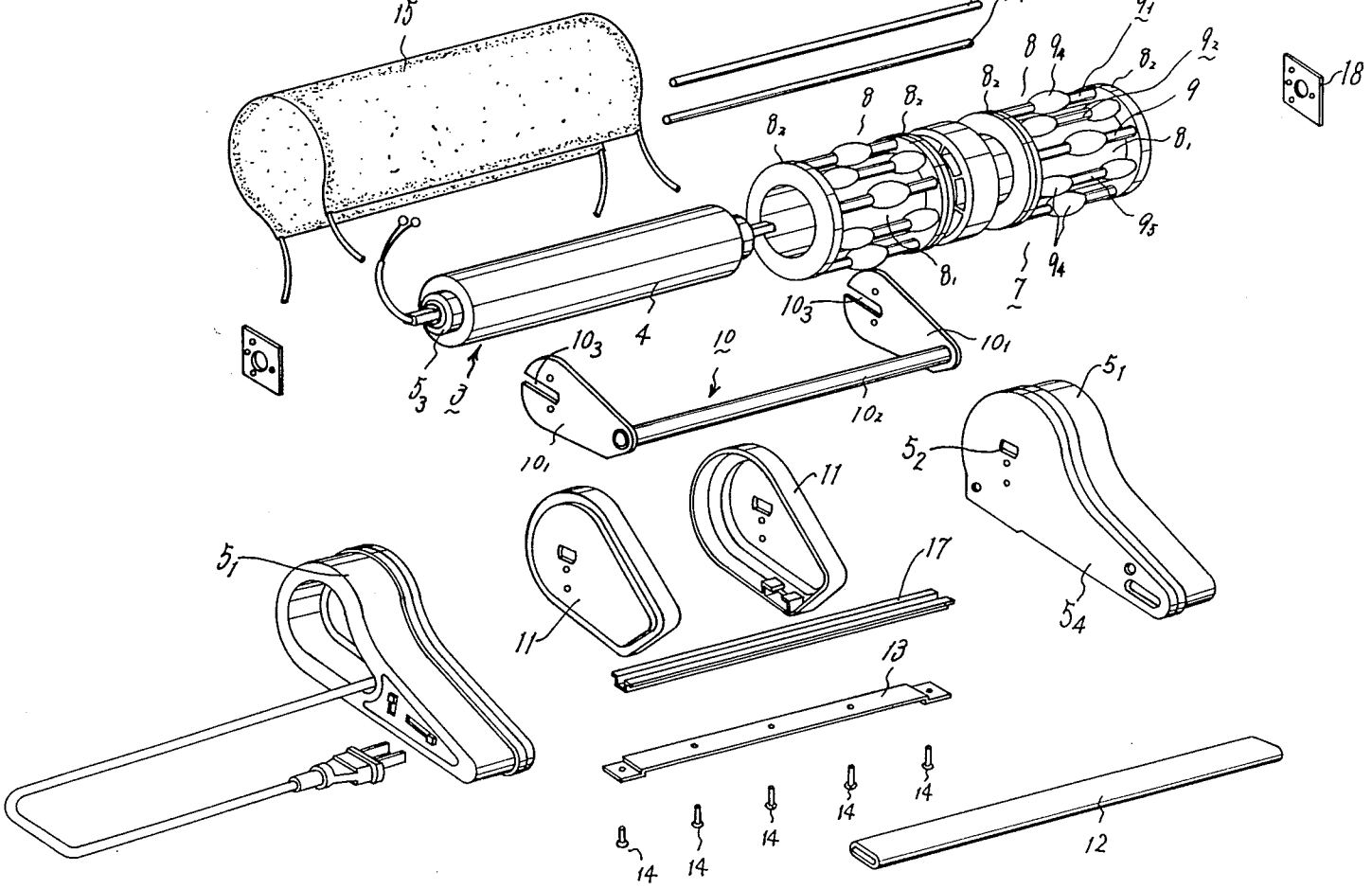
FIG. 5 is an exploded view showing an embodiment of this invention.

As shown in FIG. 5, it will be appreciated that drum cylinder 8 is made from some small size drum cylinders $8_1$ (in the illustration, divided into two parts), installed in series to enable users to install massaging member $9_4$ at a distance they desire. Installing massaging members in parts strengthens cylindrical bar 9 and both sides $8_2$ of said drum cylinder and causes few troubles such as breakage because of an accident.

Figure 2:
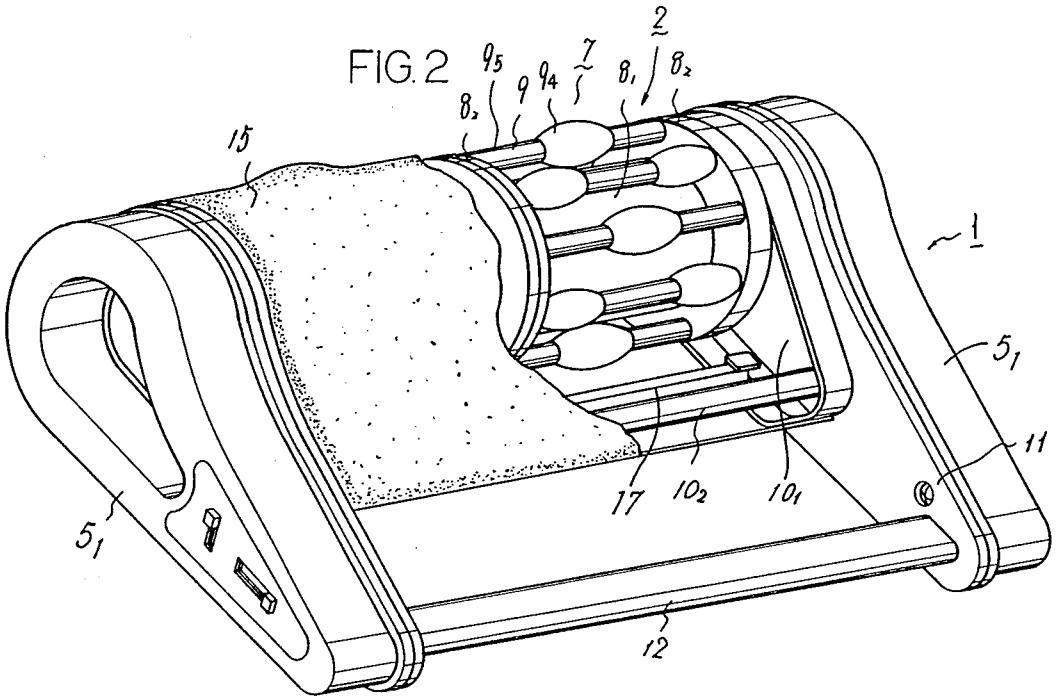
FIG. 2 is a partially cutaway view in perspective of the roll rotation type massaging apparatus shown in FIG. 1.
Figure 3:
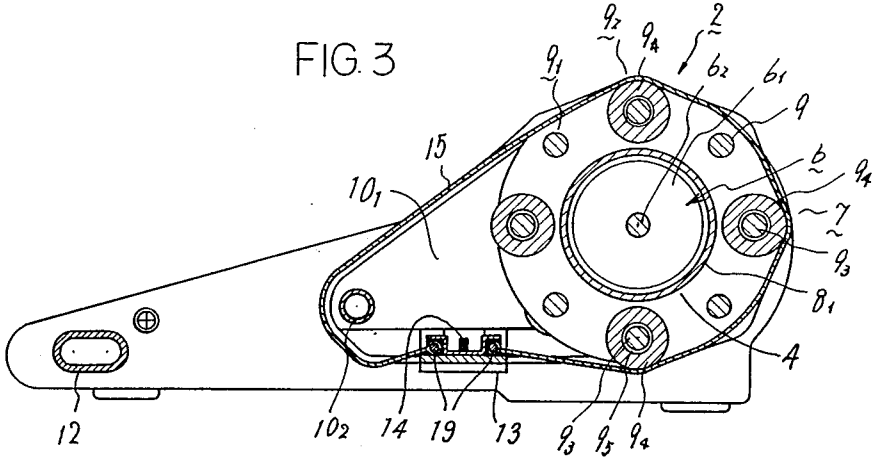
FIG. 3 is a vertical cross-section of the roll rotation type massaging apparatus shown in FIG. 1.
Figure 4:
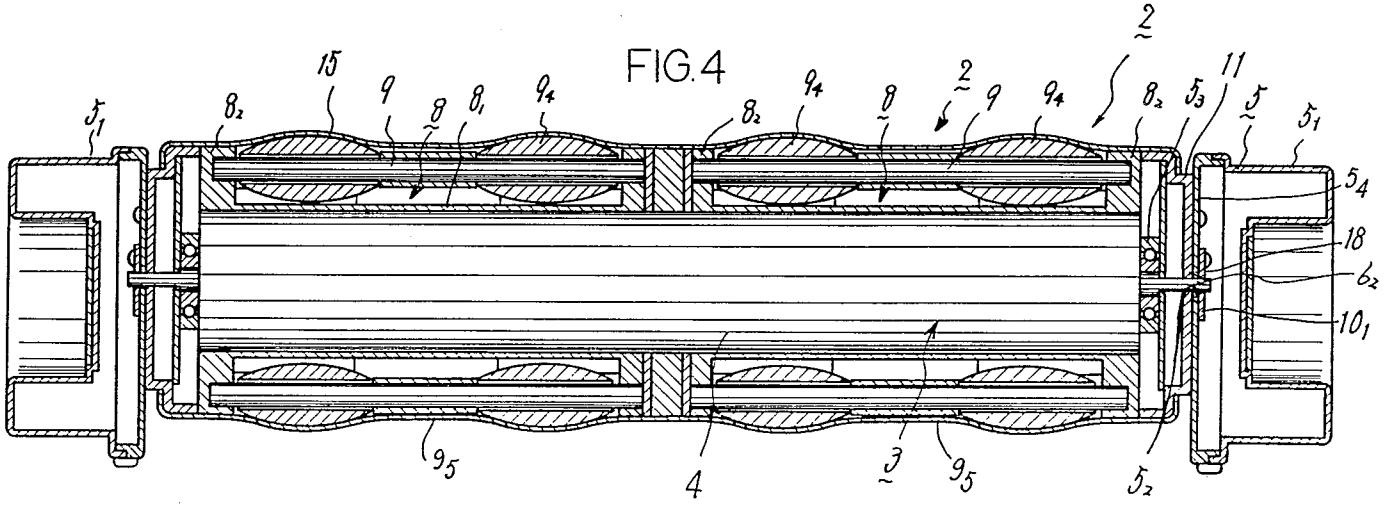
FIG. 4 is a transverse cross-section of the roll rotation type massaging apparatus shown in FIG. 1.

As further shown in FIGS. 2–5, the massaging elements $9_4$ are arranged in different patterns on the circular array of cylindrical bars 9 so as to cover different areas of contact with the user. For example, as shown by FIGS. 2 and 5, the alternate cylinder bars designated $9_1$ each have a pair of massaging elements $9_4$ mounted thereon in axially spaced relationship adjacent opposite ends of the respective bar, with the spaced massaging elements $9_4$ being maintained in axially spaced relation by a cylindrical supporting element $9_5$ which is loosely installed on the respective bar between the massaging elements. The alternate or remaining cylindrical bars designated $9_2$ have a generally reverse orientation of massaging elements $9_4$ and supporting elements $9_5$. That is, these bars $9_2$ have a single massaging element $9_4$ disposed thereon substantially at a midpoint so that it is disposed substantially in the space or gap defined between the massaging elements $9_4$ on the bars $9_1$. The single massaging element $9_4$ on the bar $9_2$ is held in position by supporting elements $9_5$ which are mounted on the bar $9_2$ on opposite sides of the respective massaging element $9_4$. This alternate arrangement of the massaging elements and adjacent bars, during rotation of the drum, creates a contact pattern with the covering 15 which resembles a wave pattern.

In operation, after installation of the roll rotation type massaging apparatus 1 according to the instant invention at a certain place, the affected part of a user is applied to the massaging members $9_4$ of said massaging apparatus 1 and then said apparatus is turned on to drive driving unit 6. These operations rotate cylindrical bars 9 at a proper speed to make said massaging members $9_4$ roll-massage the whole affected part of the user evenly.

First cylindrical bars $9_1$ and second cylindrical bars $9_2$ apply the beating part of massaging members $9_4$ to the affected part of the user in wave patterns which results in the comfortable rolling massage of the whole affected part of the user.

While particular embodiments of the invention have been illustrated in detail, it is particularly understood that the invention is not limited thereto or thereby.

What is claimed is:

1. A portable rotating roll-type massaging apparatus, comprising:

a generally U-shaped frame having a pair of generally parallel elongate end plates rigidly joined together adjacent one end thereof by an elongate connecting bar extending transversely therebetween;

a driving unit disposed between and supported on said end plates adjacent the other end thereof, said driving unit including (1) a shaft extending transversely between and nonrotatably supported on said end plates, (2) an elongate driving cylinder rotatably supported on and surrounding said shaft and disposed between said end plates, and (3) motor means disposed within said driving cylinder for drivingly rotating said driving cylinder;

an elongate roll unit extending transversely between said end plates and being concentrically and nonrotatably supported on said driving cylinder for rotation therewith about a rotational axis defined by said shaft;

said roll unit including (1) an elongate drum concentrically and nonrotatably supported on said driving cylinder, (2) a pair of axially spaced annular end flanges fixed to said drum and projecting radially outwardly therefrom, (3) a plurality of elongate support bars extending parallel with said axis so that opposite ends of said support bars are mounted on said end flanges, said support bars being spaced radially outwardly from said drum and being disposed substantially uniformly angularly spaced therearound, and (4) a plurality of roll-like massaging elements rotatably supported on said plurality of support bars.

2. An apparatus according to claim 1, wherein said U-shaped frame includes a pair of elongate end members which are respectively disposed directly adjacent and fixedly connected to said end plates, said end members having a peripheral supporting surface, a sheet-like flexible covering cloth extending between said end members and being wrapped therearound for support on said peripheral supporting surface so that said cloth externally surrounds and engages the massaging elements carried on said roll unit, and elongated clamping bar means spaced sidewardly from said roll unit and extending transversely between said end members for clampingly holding said covering in position.

3. An apparatus according to claim 2, including a pair of elongated end covers disposed adjacent and fixedly connected to the respective end members, said end covers projecting transversely outwardly beyond said end members and having a handle formed as an elongate bar extending transversely therebetween in outwardly spaced relationship from said covering.

4. An apparatus according to claim 1, including a pair of elongate end covers disposed adjacent and fixedly connected to the respective end plates, said end covers being elongate so as to project outwardly beyond said one end of said end plates, and a handle formed as an elongate bar extending transversely between outer ends of said end covers so that said handle is spaced sidewardly from said roll unit and outwardly beyond said connecting bar.

5. An apparatus according to claim 4, including a flexible sheet-like covering extending axially between said end plates and circumferentially enclosing said roll unit and said frame so that the covering assumes an elongate cross-sectional configuration and is maintained in contact with the massaging elements mounted on the roll unit over a portion of the circumferential extent thereof, said covering being fixedly anchored relative to said frame, and said handle being spaced outwardly from said covering.

6. A rotating roll-type massaging apparatus, comprising:

a rotating roll unit and a reinforcement frame;

said rotating roll unit comprising a rotating cylinder and a rotating roll;

said rotating cylinder having open ends, an inner and outer surface and a motor unit with a shaft contained therein, said shaft being positioned coaxially within said rotating cylinder and have end portions extending beyond the open ends thereof whereby the shaft is supported by bearings provided at said open ends;

said rotating roll comprising at least one drum cylinder affixed to the outer surface of said rotating cylinder, said drum cylinder having flanged ends supporting axially-extending rods having ellipsoidal-shaped massaging elements and cylindrical spacing elements disposed thereon, said rods being located at equidistant spaced intervals about the periphery of said drum cylinder and said massaging and spacing elements being disposed on said rods in such a manner that said massaging and spacing elements on any cylindrical rod are offset from the respective massaging and spacing elements on succeeding rods and is in line with the respective massaging and spacing elements on alternating rods; and said reinforcement frame comprising a pair of end plates positioned adjacent the opposite axial ends of said rotating cylinder and having slots therein for nonrotatably supporting the end portions of said shaft, and a reinforcement bar spaced sidewardly from the rotating roll and transversely connecting the pair of end plates.

* * * * *